US005177980A

United States Patent [19]

Kawamoto et al.

[11] Patent Number: 5,177,980

[45] Date of Patent: Jan. 12, 1993

[54] AUTOMATIC ICE MAKER OF REFRIGERATORS

[75] Inventors: Akira Kawamoto, Ibaraki; Hiroshi Oike, Osaka; Akihiki Ichii, Ibaraki, all of Japan

[73] Assignee: Kabushiki Kaisha Toshiba, Kawasaki, Japan

[21] Appl. No.: 690,823

[22] Filed: Apr. 26, 1991

[30] Foreign Application Priority Data

Apr. 26, 1990 [JP] Japan ..... 2-110875

[51] Int. Cl.[5] ..... F25C 1/20

[52] U.S. Cl. ..... 62/353; 62/68

[58] Field of Search ..... 62/68, 72, 353, 340, 62/66

[56] References Cited

U.S. PATENT DOCUMENTS

| | | | |
|---|---|---|---|
| 2,971,346 | 2/1961 | Frei | 62/353 X |
| 3,224,213 | 12/1965 | Hoyt, Jr. | 62/68 |
| 3,318,105 | 5/1967 | Burroughs et al. | 62/66 X |
| 3,321,932 | 5/1967 | Orphey, Jr. | 62/340 |
| 3,449,921 | 6/1969 | Connors | 62/72 X |
| 3,775,992 | 12/1973 | Bright | 62/353 X |
| 4,852,359 | 8/1989 | Mazzotte | 62/68 |

*Primary Examiner*—William E. Tapolcai

*Attorney, Agent, or Firm*—Cushman, Darby & Cushman

[57] ABSTRACT

In an automatic ice maker of a refrigerator, water is supplied into an ice tray disposed in an ice making compartment of the refrigerator. The water in the ice tray is frozen and then, the ice tray is turned with a twisting motion by a drive mechanism including a motor so that ice cubes are removed from the ice tray. Vibration is applied to the ice tray by an electromagnet excited by a pulse current during a water freezing step so that escape of air bubbles out of the water is promoted. A cover covers an upper open end of the ice tray during the water freezing step so that freezing is retarded at the water surface side as compared with the ice tray bottom side. Alternatively, a heater is employed for the cover.

9 Claims, 21 Drawing Sheets

AUTOMATIC ICE MAKER OF REFRIGERATORS

BACKGROUND OF THE INVENTION

This invention relates to an automatic ice maker for refrigerators which automatically provides ice cubes, and more particularly to an automatic ice maker of the type that water is supplied into an ice tray disposed in an atmosphere of chilled air and then froze therein.

Household refrigerators equipped with automatic ice makers have been commercially produced One type of such automatic ice makers comprises a refrigerated plate, refrigerated such that the surface temperature thereof is decreased below the freezing point and a water circulator dispersing water over the refrigerated plate surface so that the water forms a membrane over the surface and circulating the water. Ice is gradually made in the process that the water is caused to flow on the plate. This type of ice maker is advantageous in that transparent ice can be obtained. However, the construction is large and complicated.

In another type of automatic ice maker, water is supplied into an ice tray disposed in an ice making compartment by water supply equipment. After ice is made, the ice tray is rotatively moved by a drive mechanism so as to be reversed, thereby removing ice cubes from the ice tray to be reserved Subsequently, water is repeatedly resupplied into the ice tray and ice is made.

In the latter type, however, the water supplied into the ice tray is frozen nearly uniformly from every side of the ice tray. Consequently, air bubbles are often left in the ice cubes and render the ice cubes opaque.

SUMMARY OF THE INVENTION

Therefore, an object of the present invention is to provide an ice maker for refrigerators which can efficiently make transparent ice cubes.

The present invention provides an ice maker for a refrigerator. The ice tray is provided with a frame member and a support member. The ice maker includes an ice tray disposed between the frame member and the support member. The ice tray has opposite ends which are supported by the frame member and the support member respectively, so that the ice tray is rotatively and axially moved. The ice tray has an open upper end, spring means axially imparting a spring force to the ice tray so that the ice tray is urged toward either frame or support member, water supply means for supplying water to the ice tray, refrigerating means for freezing the water in the ice tray, vibration applying means for applying motion to the ice tray in a direction against the spring force of the spring means in the water freezing stage thereby vibrating the ice tray, a cover member covering the open upper end of the ice tray in the water freezing stage so that the freezing of the water at a water surface side is retarded relative to the freezing of the water at a bottom side of the ice tray, and a drive mechanism for rotatively moving the ice tray after freezing of the water therein and twisting the ice tray so that ice is removed from the ice tray.

In accordance with the above-described ice maker, the ice tray containing water is vibrated by the vibration applying means in the ice making stage. The water in the ice tray is also vibrated such that air bubbles adherent to a boundary surface between the water and ice is promoted to escape from the water. Consequently, a period of time necessary for making the transparent ice can be shortened. Furthermore, since the upper open end of the ice tray is covered by the cover, freezing the water is retarded at the water surface side. The water is thus frozen from the bottom side and the water surface is frozen last. The air bubbles contained in the water can escape from the water through the water surface. Consequently, transparent ice without any air bubbles can be made in a short period of time.

Heating means may be provided as another means for retarding the water freezing at the water surface side so that heat is applied to the water surface in the ice tray in the water freezing step. Additionally, gas guide means may be provided for guiding, in the water freezing step, a gas from a storage compartment of the refrigerator into a space over the water surface in the ice tray so that the freezing of the water at the water surface side is retarded relative to the freezing of the water at the bottom side of the ice tray.

It is preferable that the vibration applying means include electromagnetic coil means reciprocally moving the ice tray axially.

It is also preferable that an outer periphery of water containing concave portions of the ice tray, except for a bottom face thereof, be covered by a heat insulating member. Consequently, the water in the ice tray can be frozen from the bottom side smoothly.

Furthermore, it is preferable that the cover member be rotatably supported at one end by a shaft parallel to a rotational axis of the ice tray so that the cover member is rotated in contact with the ice tray with rotation of the same.

Other objects of the present invention will become obvious upon understanding of the illustrative embodiments about to be described. Various advantages not referred to herein will occur to one skilled in the art upon employment of the invention in practice.

DESCRIPTION OF THE PREFERRED EMBODIMENTS

A first embodiment of the present invention will be described with reference to FIGS. 1 to 8 of the drawings.

Figure 2:
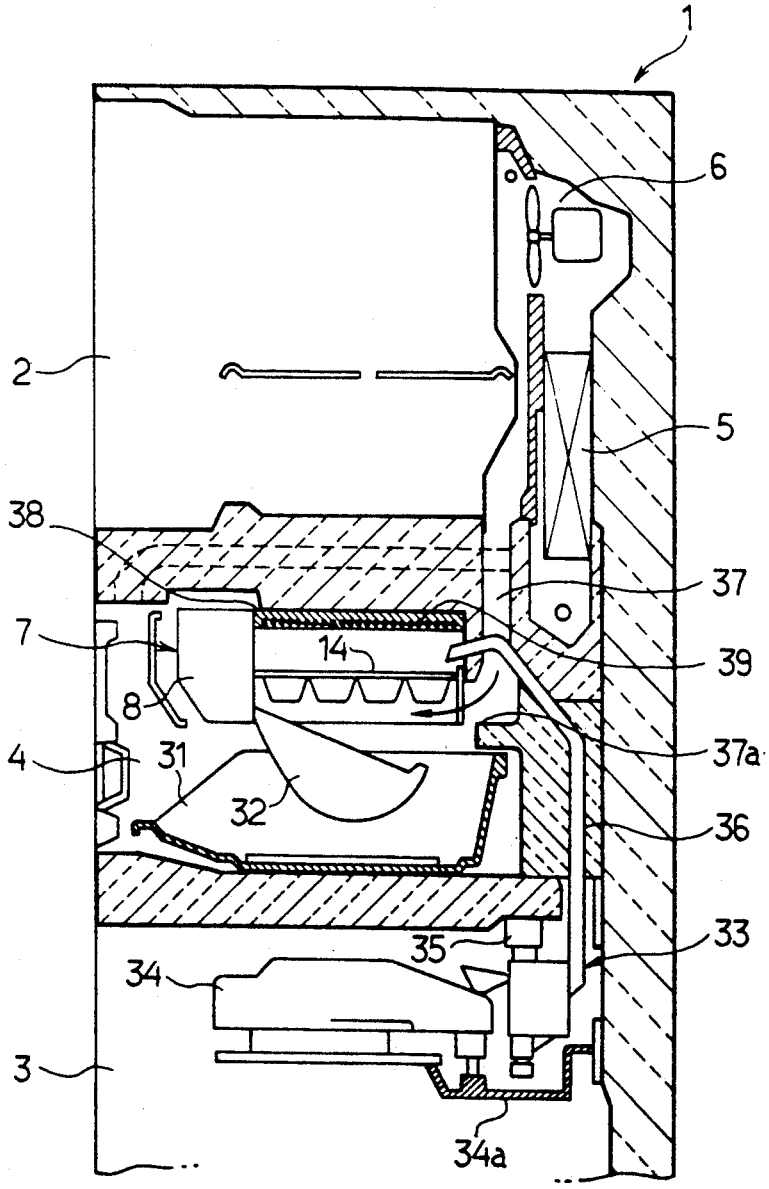
FIG. 2 is a longitudinal section of a refrigerator equipped with the ice maker.

Referring first to FIG. 2, a refrigerator cabinet 1 has therein a freezing compartment 2, a storage compartment 3, an ice making compartment 4 and the like. Air chilled by an evaporator 5 is supplied to the compartments 2, 3 and 4 by a fan 6. An automatic ice maker 7 in accordance with the principles of the present invention is provided in the ice making compartment 4. The automatic ice maker 7 will be described in detail below.

Figure 1:
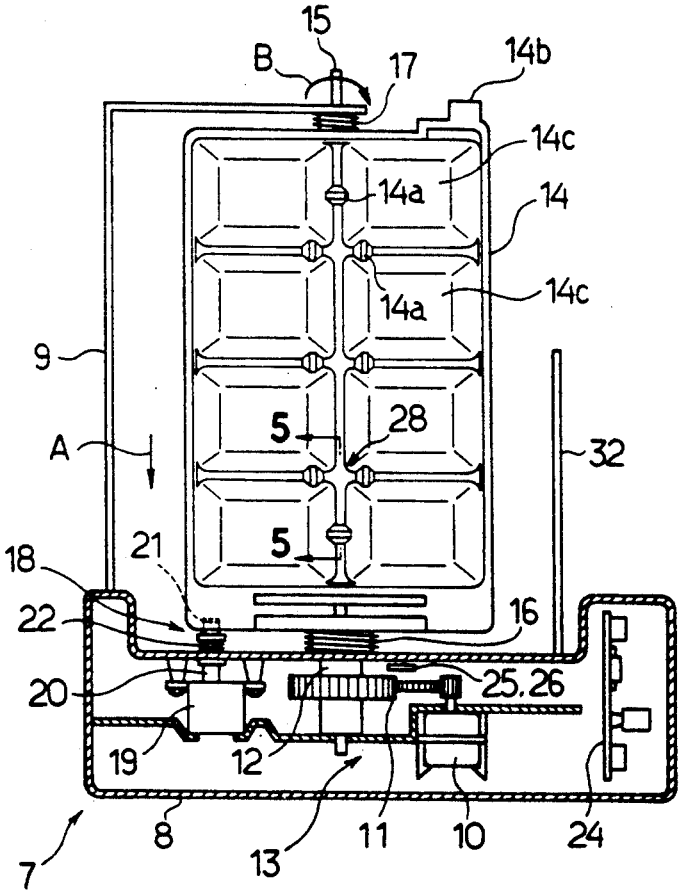
FIG. 1 is a broken plan view of an ice maker of a first embodiment of the present invention.

A generally rectangular box-shaped frame 8 is provided in the upper front interior of the ice making compartment 4. A generally L-shaped support member 9 is provided on an end of the rear of the frame 8 so as to extend rearwardly, as is shown in FIG. 1. A drive mechanism 13 comprising an electric motor 10, a reduction gear mechanism 11 and an output shaft 12 is provided in the frame 8. Rotation of the motor 10 is suitably reduced by the reduction gear mechanism 11 and then, transmitted to the output shaft 12. An ice tray 14 is formed of a plastic material, for example. The ice tray 14 has an upper open end and is formed into the shape of a thin rectangular box. The interior of the ice tray 14 is divided into a plurality of concave portions 14*c* communicated to one another by grooves 14*a*. The ice tray 14 is supported by the output shaft 12 at the central front and by the support member 9 via a support shaft 15 at the central rear so that the ice tray 14 is moved in the directions of and rotatively moved about the shafts 12 and 15. A compression coil spring 16 is provided between the frame 8 and the ice tray 14 through the output shaft 12. Another compression coil spring 17 is provided between the ice tray 14 and the support member 9 through the support shaft 15. The ice tray 14 has a convex portion 14*b* formed on a rear end thereof. The convex portion 14*b* is engaged with the support member 9 when the ice tray 14 is rotatively moved so as to be inverted, thereby preventing further rotative movement of the ice tray 14.

Figure 3:
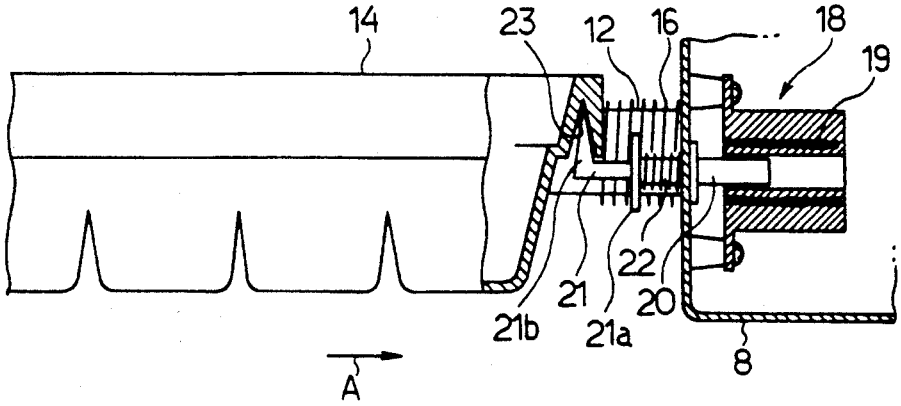
FIG. 3 is a broken side view of a vibration applying mechanism of the ice maker.
Figure 4:
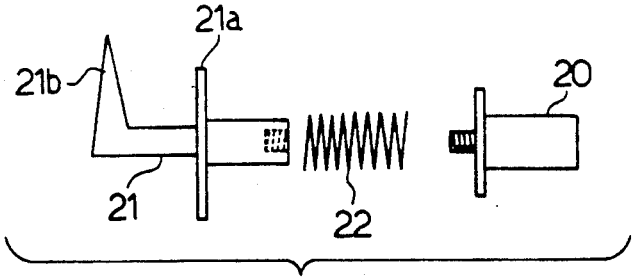
FIG. 4 is exploded side view of the vibration applying mechanism.

Reference numeral 18 designates a vibration applying mechanism as vibration applying means for vibrating the ice tray 14 so that it is moved in the directions of the shaft 12 and 15. The vibration applying mechanism 18 comprises an electromagnet 19 disposed at a position away from the output shaft 12 toward one side of the ice tray 14, a movable iron core 20 movably inserted in the electromagnet 19, a vibration transmission member 21 threadably engaged with an end of the movable core 20, and a compression coil spring 22 provided between a flange 21*a* of the vibration transmission member 21 and the rear wall of the frame 8 around the vibration transmission member, as shown in FIGS. 3 and 4. A distal claw portion 21*b* of the vibration transmission member 21 is disengageably engaged, from below, with a generally inverted V-shaped engaged portion 23 formed in an edge portion of the ice tray 14. Upon energizing the electromagnet 19, the movable core 20 is attracted against the compression coil spring 22 in the direction of arrow A. With this movement of the movable core 20, the ice tray 14 is moved through the vibration transmission member 21 in the same direction as the movable core 20 is attracted. When the electromagnet 19 is deenergized, the compression coil spring 22 forces the movable core 20, the vibration transmission member 21 and the ice tray 14 to move together in the direction opposite arrow A. These movements are repeated to axially vibrate the ice tray 14.

Figure 5:
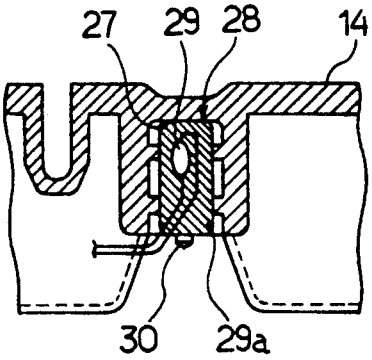
FIG. 5 is an enlarged longitudinal section of a temperature sensor taken along line 5—5 in FIG. 1.

In the frame 8 are provided a circuit board 24, a horizontal position detecting switch 25 disposed in the vicinity of the output shaft 12 for detecting the horizontal position of the ice tray 14, and an inverted ice tray position detecting switch 26 for detecting the position of the ice tray 14 inverted. A generally circular recess 27 is formed in a predetermined portion of the ice tray 14, as shown in FIG. 5. The recess 27 has an open underside. Reference numeral 28 designates a cylindrical temperature sensor comprising a thermistor 29 molded out of a molding material 29*a*. The temperature sensor 28 is inserted in the recess 27 such that the thermistor 29 is in the vicinity of the ice tray wall and secured by an engagement claw 30 formed on the ice tray 14. The temperature sensor 28 is provided for sensing the temperature of the upper side of the ice tray 14.

Figure 6:
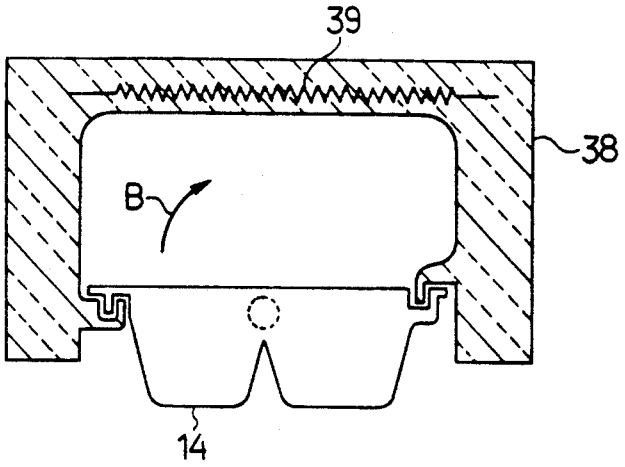
FIG. 6 is a longitudinal front view of an ice tray and a cover shown in FIG. 2.

Referring to FIG. 2, an ice reserving box 31 is drawably provided below the ice tray 14 in the ice making compartment 4. A reserved ice detecting lever 32 is rotatably mounted on the frame 8. Reference numeral 33 designates water supply means for supplying the ice tray 14 with water. Water reserved in a water-supply tank 34 contained in the storage compartment 3 is received by a water-receiving pan 34*a*. The water received by the pan 34*a* is supplied to the ice tray 14 through a water-supply pipe 36 by a water-supply pump 35. A distal end of the water-supply pipe 36 faces the ice tray 14. A chilled air supply port 37*a* of a chilled air supply duct 37 supplying chilled air to the ice making compartment 4 is directed to the underside of the ice tray 14 so that the chilled air is mainly caused to flow along the underside of the ice tray 14. A cover 38 formed from a heat insulation material is provided in the ice making compartment 4 for covering the upper side of the ice tray 14. A heater 39 is embedded in the upper portion of the cover 38 as shown in FIG. 6. The cover 38 is constructed so as to allow the ice tray 14 to be moved in the directions of, and rotatively moved about, the shafts 12 and 15.

Figure 7:
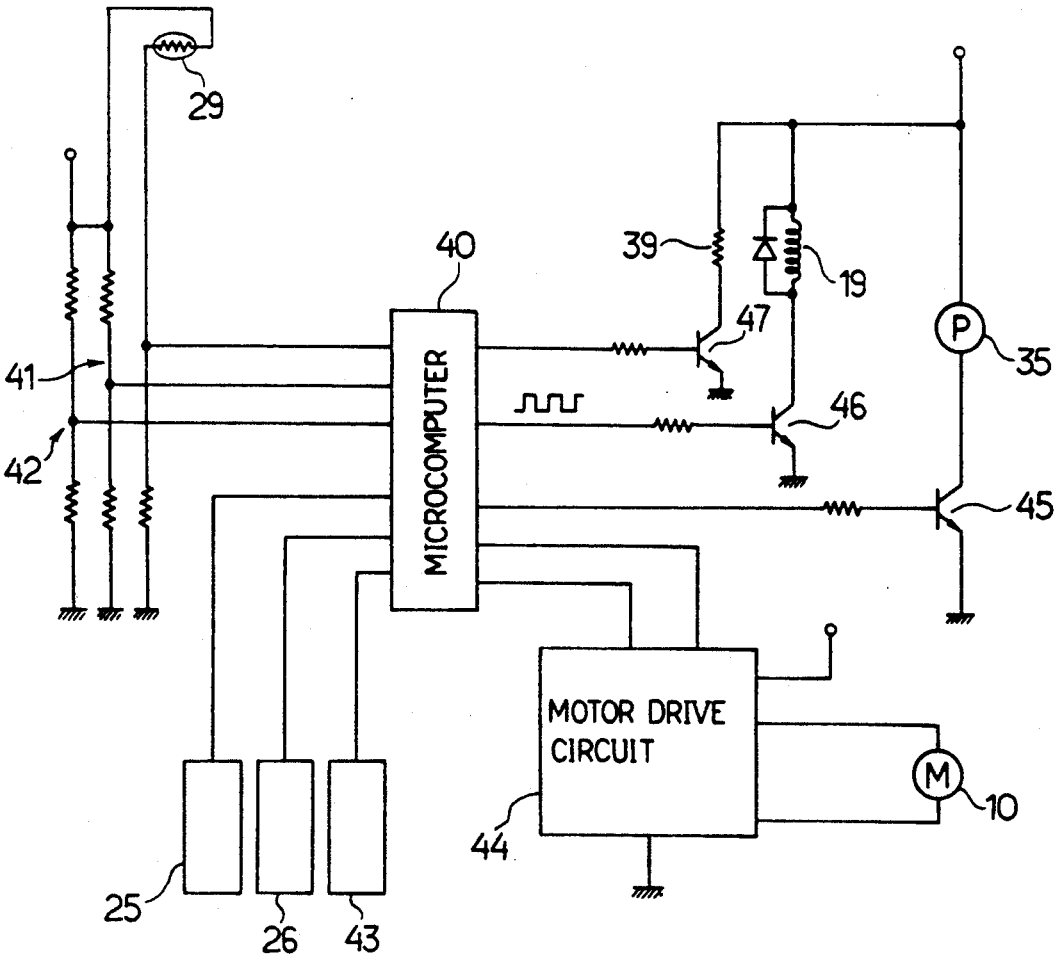
FIG. 7 is a control circuit diagram.

FIG. 7 shows an electric circuit of the automatic ice maker 7. A microcomputer 40 is provided for controlling steps of the ice making as will be described below. The microcomputer 40 is supplied with a voltage signal representative of the temperature of the ice tray 14 sensed by the thermistor 29 of the temperature sensor 28, a reference voltage generated by a first reference voltage generating circuit 41 so as to be representative of a water-supply completion temperature of the ice tray 14 (−9.5° C., for example) and a second reference voltage generated by a second reference voltage generating circuit 42 so as to be representative of an ice-making completion temperature of the ice tray 14 (−12.0° C., for example). Furthermore, detection signals are supplied to the microcomputer 40 from the horizontal position detecting switch 25, the inverted ice tray position detecting switch 26 and the reserved ice detecting switch 43 responsive to the reserved ice detecting lever 32. The motor 10 is connected to the microcomputer 40 through a motor drive circuit 44. The water-supply pump 35, the electromagnetic coil 19 and the heater 39 are also connected to the microcomputer 40 through transistors 45, 46, 47, respectively so as to be controlled by the microcomputer 40 in a manner as will be described later.

Figure 8:
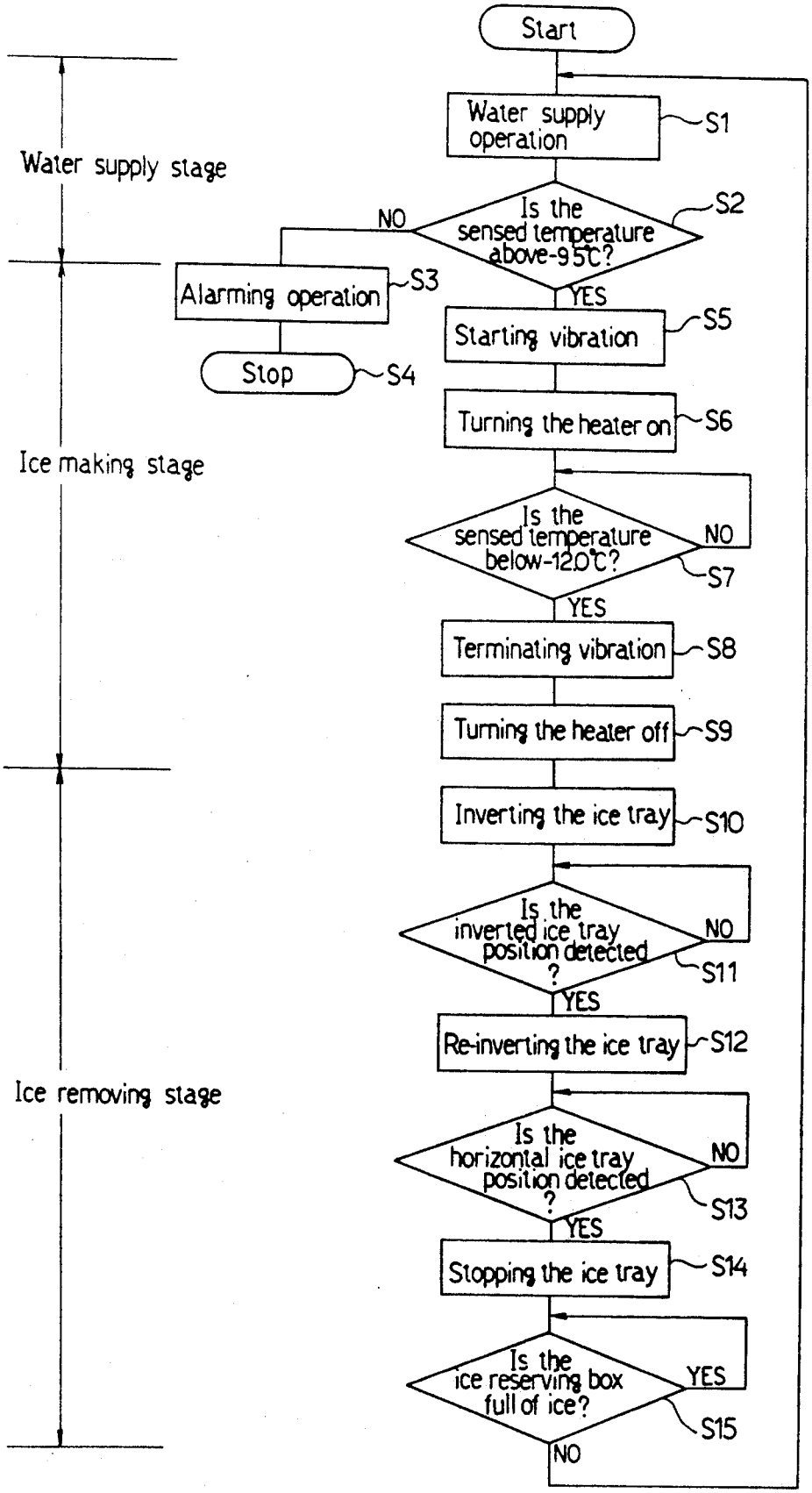
FIG. 8 is a flowchart for explaining the operation of the ice maker.

The operation of the ice maker thus constructed will now be described with reference to the flowchart of FIG. 8 showing the control manner of the microcomputer 40.

In a stage of supplying water to the ice tray, the water-supply pump 35 is driven for a predetermined period of time through the transistor 45 at step S1 so that a predetermined amount of water is fed into the concave portions 14*c* of the ice tray 14. At step S2, the voltage signal representative of the temperature sensed by the thermistor 29 of the temperature sensor 28 is compared with the reference voltage from the first reference voltage generating circuit 41 so that it is determined whether or not the water supply has been completed. More specifically, when the temperature sensed by the temperature sensor 28 is lower than the water supply completion temperature (−9.5° C.), for example 3.5 minutes after actuation of the water-supply pump 35, it is determined that the water supply has not been performed for the reason, for example, that no water is reserved in the water supply tank 34. In this case, an alarming operation is performed at step S3 and the ice making operation is interrupted. On the other hand, when the temperature sensed by the temperature sensor 28 is higher than the water supply completion temperature, it is determined that the water supply has been completed, and an ice making step is initiated.

In the ice making stage, the microcomputer 40 delivers a voltage signal with a pulse waveform as shown in FIG. 7 to the transmistor 46 at step S5. With this, the electromagnetic coil 19 is controlled through the transistor 46 so as to be energized and deenergized, whereby the ice tray 14 is vibrated by the vibration applying means 18 in the directions of the shafts 12 and 15 or in the directions of arrow A and opposite arrow A. At step S6, the heater 39 is energized through the transistor 47. Since the chilled air from the chilled air outlet 37*a* is mainly directed to the underside of the ice tray 14 and the water is vibrated with vibration of the ice tray 14 in the ice making stage, the escape of air bubbles from the water in the ice tray 14 is prompted. Furthermore, the water surface side is difficult to freeze since the upper side of the ice tray 14 is covered by the cover 38. Additionally, the water surface side is heated by the heater 39. Consequently, the ice making is retarded at the water surface side and the ice making is first initiated at the bottom side of the ice tray 14, progressing to the water surface side. The air bubbles contained in the water can thus be caused to escape from the unfrozen water surface side. As a result, transparent ice cubes can be made in a shortened period of time.

At step S7, the voltage signal representative of the temperature sensed by the thermistor 29 of the temperature sensor 28 is compared with the second reference voltage from the second reference voltage generating circuit 42 so that it is determined whether or not the ice making stage is completed. It is determined that the ice making stage has been completed when the temperature sensed by the temperature sensor 28 is lower than the ice making completion temperature (−12.0° C.), thereby deenergizing the electromagnetic coil 19 to terminate vibration of the ice tray 14 at step S8. The heater 39 is then deenergized at step S9 and the microcomputer 40 advances to an ice removing stage.

The motor 10 is energized through the motor drive circuit 44 to be driven at step S10 and consequently, the ice tray 14 is rotatively moved in the direction of arrow B in FIG. 1 by the drive mechanism 13, thereby inverting the ice tray 14. When the convex portion 14*b* of the ice tray 14 is engaged with the support member 9, the ice tray 14 is twisted such that the ice cubes fall out into the ice reserving box 31, thus executing the ice removing operation. In this regard, the engaged portion 23 of the ice tray 14 is disengaged from the claw portion 21*b* of the vibration transmission member 21 with the rotative movement of the ice tray 14. When the position of the ice tray 14 inverted is detected by the inverted ice tray position detecting switch 26 at step S11, the microcomputer 40 advances to step S12. At step S12, the motor 10 is driven so as to be rotated in the direction opposite than in inverting the ice tray 14, thereby turning the ice tray 14 in the direction opposite arrow B. When the former horizontal position of the ice tray 14 is detected by the horizontal position detecting switch 25 at step S13, the motor 10 is deenergized to terminate rotation of the ice tray 14, thereby returning the ice tray to the former position at step S14. In this case, the engaged concave portion 23 of the ice tray 14 is re-engaged with the claw portion 21*b* of the vibration transmission member 21. At step S15, it is determined by the reserved ice detecting 43 whether or not the ice reserving box 31 is filled full with the ice cubes. When it is determined that the ice reserving box 31 is not filled full with the ice cubes, the microcomputer 40 returns to step S1. On the other hand, the microcomputer 40 is on standby when it is determined that the ice reserving box 31 is full of the ice cubes. Thus, the transparent ice cubes can be made automatically.

In accordance with the above-described first embodiment, the escape of the air bubbles from the water is prompted since the ice tray 14 is vibrated by the vibration applying mechanism 18 during the ice making stage. Furthermore, since the upper side of the ice tray 14 is covered by the cover 38 and the water surface side is heated by the heater 39, the ice making is retarded at the water surface side. The water in the ice tray 14 is first frozen from the bottom side to the water surface side. Accordingly, the air bubbles contained in the water are allowed to escape therefrom through the water surface. Consequently, the transparent ice cubes containing no air bubbles can be made in a shortened period of time. Additionally, since the chilled air is mainly directed to the underside of the ice tray 14, the water can be frozen from the bottom side more reliably.

Furthermore, since the ice tray 14 is vibrated in the directions of the shafts 12 and 15 about which the same is rotatively moved, a simple construction for vibrating the ice tray 14 can be achieved.

Additionally, since the temperature sensor 28 is adapted to sense the upper portion of the ice tray 14 where the water is made into ice last, the ice making completion temperature can be detected with more reliability.

Figure 9:
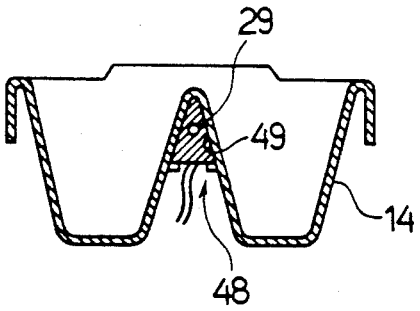
FIG. 9 is a longitudinal front view of a modified form of the temperature sensor.
Figure 10:
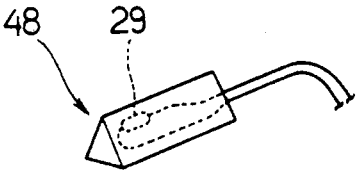
FIG. 10 is a perspective view of the temperature sensor shown in FIG. 9.

FIGS. 9 and 10 show a modified form of the temperature sensor employed in the foregoing embodiment. The temperature sensor 48 with the thermistor 29 embedded is formed into a generally triangle pole. The thermistor 29 is disposed in the ridge portion of the temperature sensor 48. The temperature sensor 48 is disposed in the inverted V-shaped recessed portion 49 in the underside of the ice tray 14 so that the thermistor 29 is in the vicinity of the ice tray wall, whereby the temperature of the upper portion of the ice tray 14 is sensed by the temperature sensor 48.

Figure 11:
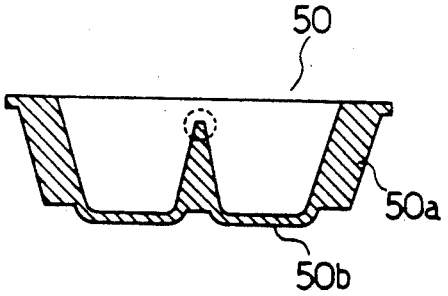
FIG. 11 is a longitudinal front view of a first modified form of the ice tray.

FIG. 11 shows a first modified form of the ice tray. The thickness of each side wall 50*a* of the ice tray 50 is larger than the thickness of the bottom wall 50*b* thereof. Since the thermal conductivity of each side wall 50*a* is rendered lower than that of the bottom wall 50*b*, the water in the ice tray 50 can be frozen from the bottom side with more reliability.

Figure 12:
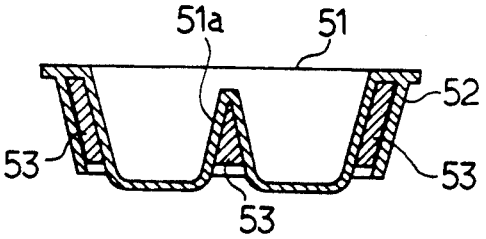
FIG. 12 is a longitudinal front view of a second modified form of the ice tray.
Figure 13:
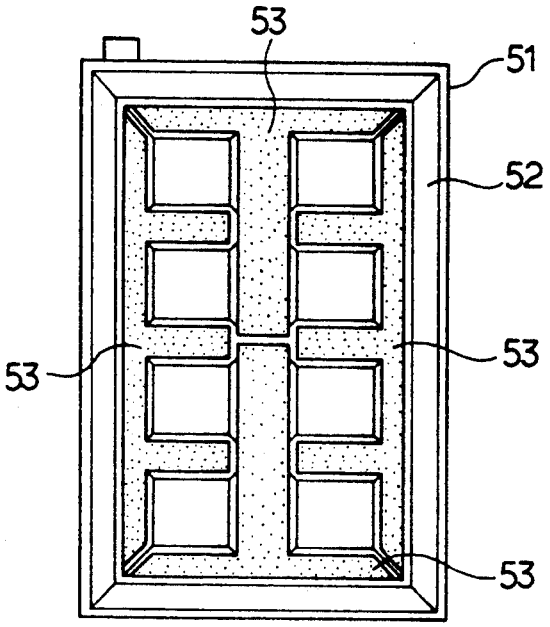
FIG. 13 is a bottom view of the ice tray of the second modified form.

FIGS. 12 and 13 show a second modified form of the ice tray. An enclosure wall 52 is formed integrally with the ice tray 51 so as to enclose the same. A heat insulating material is fitted in the ridge portion between the concave portions 51*a* and between the inner surface of the enclosure wall and the outer surfaces of the concave portions 51*a*. The heat insulating material is divided into four pieces and bonded only to the inner surface of the enclosure wall 52 with an adhesive in order that it is prevented from being damaged when the ice tray 51 is twisted in the ice removing stage. Since the outside surface of each concave portion 51*a* is covered by the heat insulating material and the bottom is exposed, the thermal conductivity of each side wall portion of the ice tray 51 is lower than that of the bottom thereof.

Figure 14:
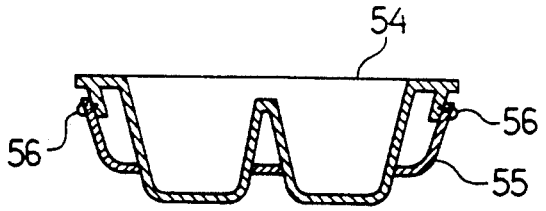
FIG. 14 is a longitudinal section of a third modified form of the ice tray.
Figure 15:
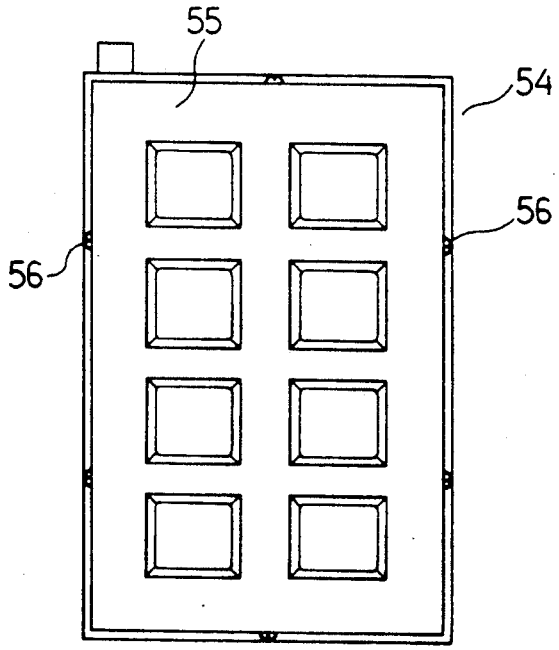
FIG. 15 is a bottom view of the ice of the third modified form.
Figure 16:
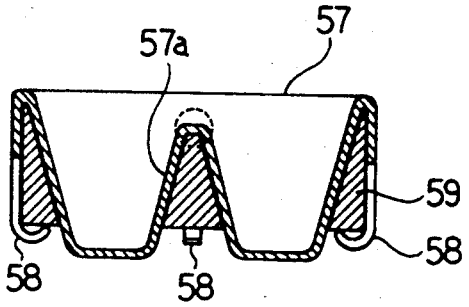
FIG. 16 is a longitudinal front view of a fourth modified form of the ice tray.
Figure 17:
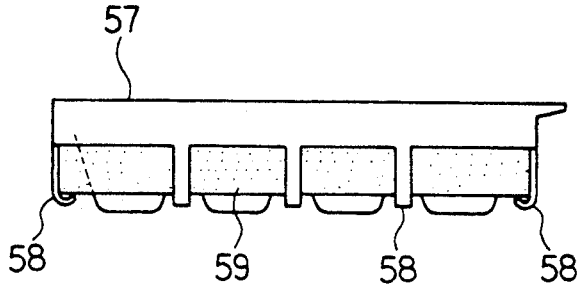
FIG. 17 is a side view of the ice tray of the fourth modified form.
Figure 18:
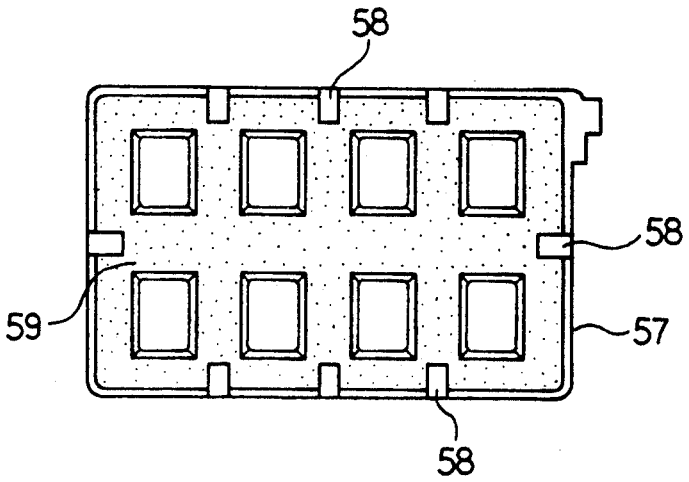
FIG. 18 is a bottom view of the ice tray of the fourth modified form.

FIGS. 14 and 15 show a third modified form of the ice tray. A soft rubber cover 55 is attached to the underside of the ice tray 54 by screws 56 such that the outside surface of the concave portions 54*a* is covered by the cover 55 with the bottom of the ice tray 54 exposed. Consequently, the thermal conductivity of each side wall portion of the ice tray 54 is lower than that of the bottom thereof.

Figure 19:
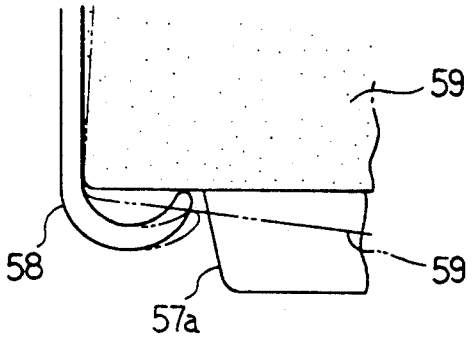
FIG. 19 is an enlarged front view of a support claw of the ice tray.

FIGS. 16 to 19 illustrate a fourth modified form of the ice tray. A plurality of elastically deformable support claws 58 are formed on the periphery of the ice tray 57. The heat insulating material 59 is fitted in the ridge portion between the concave portions 57*a* and supported by the support claws 58 on the outer surface of each side wall of the ice tray 57 such that the outside surface of each concave portion 57*a* is covered by the heat insulating material 59. The outside surface of each concave portion 57*a* is covered by the heat insulating material 59 with the bottom thereof exposed. An adhesive is not employed for attachment of the heat insulating material 59. Since the heat insulating material 59 is supported only by the support claws 58 formed at intervals on the ice tray periphery, the heat insulating material 59 can be moved relative to the ice tray 57 with elastic deformation of the support claws 58 when the ice tray 57 is twisted in the ice removing stage, as shown in FIG. 19. Consequently, the ice tray 57 and the heat insulating material 59 can be prevented from being damaged when the ice tray 57 is twisted.

Figure 20:
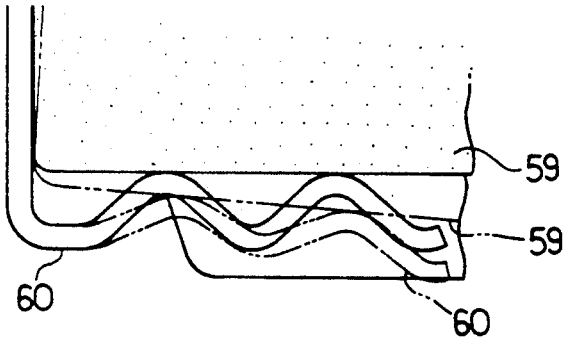
FIG. 20 and 21 are views similar to FIG. 19 showing first and second modified forms of the support claw, respectively.

FIG. 20 illustrates a first modified form of the above-described support claws. Each support claw 60 has a distal end longer than each support claw 58 and the distal end of each claw 60 is corrugated such that each claw 60 is further elastically deformable.

Figure 21:
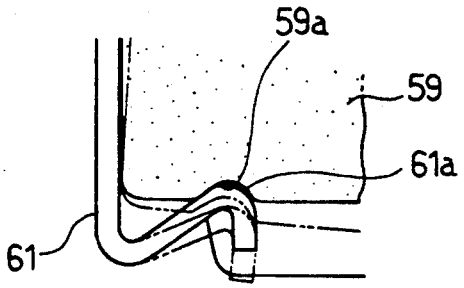

FIG. 21 shows a second modified form of the support claws. The distal end of each support claw 61 is bent upwardly and has a convex portion 61*a* with a curved upper face. Each convex portion 61*a* is disengageably engaged with each concave portion 59*a* formed in the heat insulating material 59.

Figure 22:
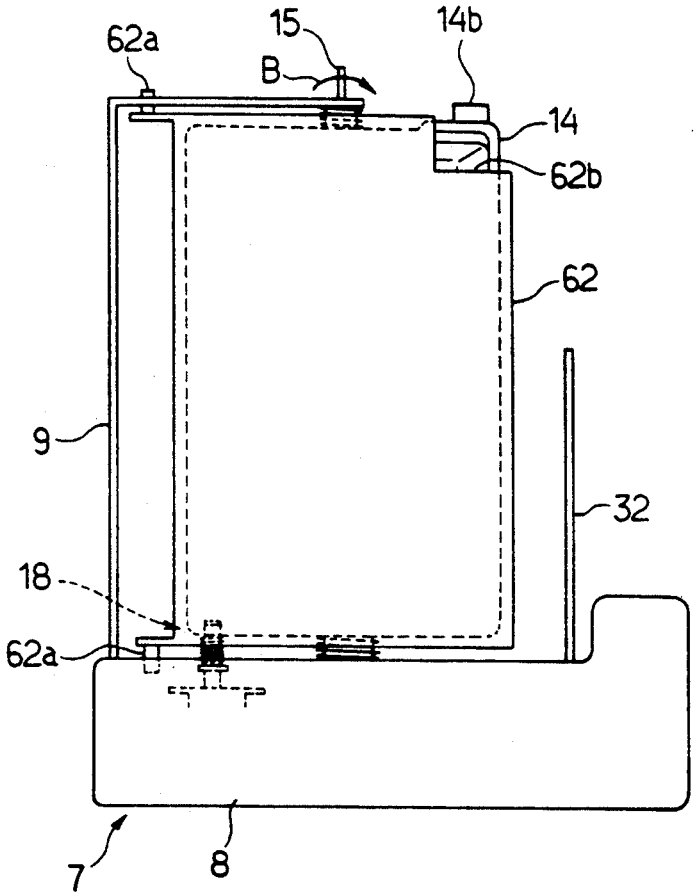
FIG. 22 is a plan view of the ice maker of a second embodiment.
Figure 23:
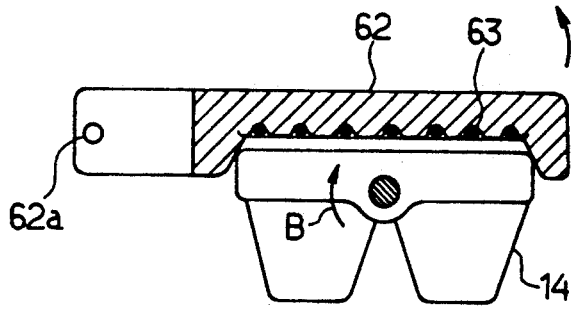
FIG. 23 is longitudinal front view of the ice tray and the cover.
Figure 24:
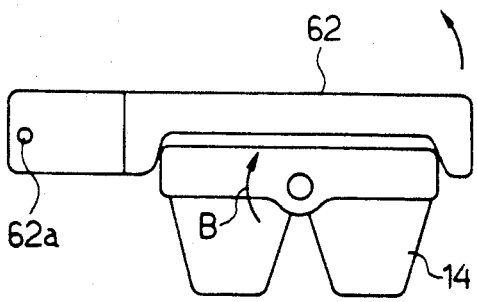
FIGS. 24(*a*) to 24(*e*) are views of the ice maker for explaining the operation thereof.
Figure 24:
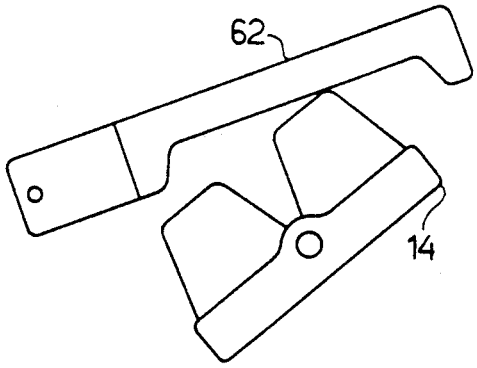
Figure 24:
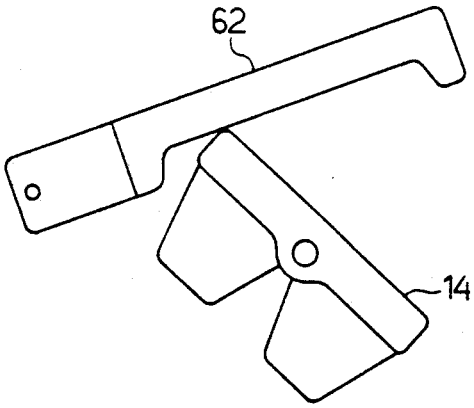
Figure 24:
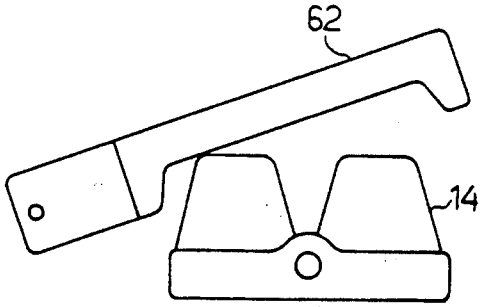
Figure 24:
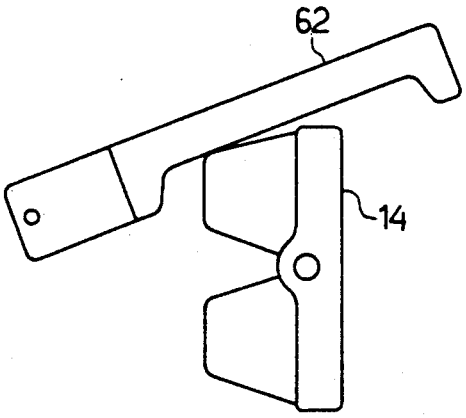

FIGS. 22 to 24 illustrate a second embodiment of the invention. The difference between the first and second embodiments will be described. The upper side of the ice tray 14 is covered by a cover 62 formed of a heat insulating material. The cover 62 is supported by shafts 62*a* provided on the respective front and rear of the cover 62 at one side thereof for rotative movement between the frame 8 and the support 9 and axial movement. The cover 62 has, at the free end, a cut-out portion 62*b* allowing the distal end of the water-supply pipe 36 to face the ice tray 14. The heater 63 is provided on the inner surface of the cover 62 for heating the water surface side of the ice tray 14.

In making ice, the upper side of the ice tray 14 is covered by the cover 62 and the cover 62 is moved with the ice tray 14 vibrated axially by the vibration applying mechanism 18. Furthermore, the heater 63 is energized to heat the water surface side of the ice tray 14 in making ice. When the ice tray 14 is rotatively moved in the direction of arrow B after completion of the ice making, the cover 62 is rotatively moved about the shafts 62*a* with rotative movement of the ice tray 14 as shown in FIGS. 24(*a*) to 24(*e*) such that the ice cubes are removed from the ice tray 14. Upon completion of the ice removal, the ice tray 14 is returned to the former horizontal position and the cover 62 is also returned to the former state with return of the ice tray 14.

In accordance with the second embodiment, a space between the ice tray 14 and the cover 62 is narrow and closed by the cover 62. The heater 63 is positioned in the vicinity of the upper side of the ice tray 14. Consequently, freezing the water surface side can be retarded with more reliability and accordingly, the transparent ice cubes can be made with more reliability.

Figure 25:
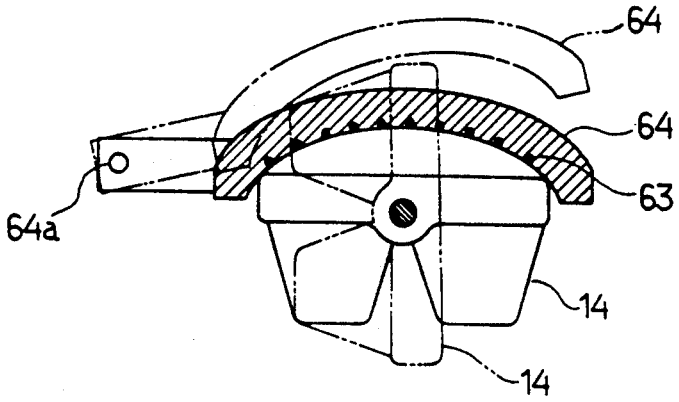
FIG. 25 is a longitudinal front view of the cover of a first modified form.

FIG. 25 illustrates a first modified form of the cover in the above-described second embodiment. The cover 64 is formed into the shape of an arc. Consequently, an amount of upward movement of the cover 64 can be reduced and a space over the cover 64 can be reduced.

Figure 26:
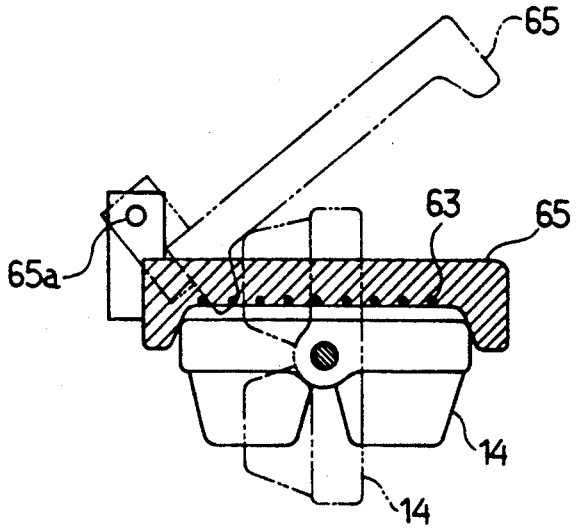
FIG. 26 is a longitudinal front view of the cover of a second modified form.

FIG. 26 illustrates a second modified form of the cover. A shaft 65*a* about which the cover 65 is rotatively moved is positioned above the cover 65 in the closed position.

Figure 27:
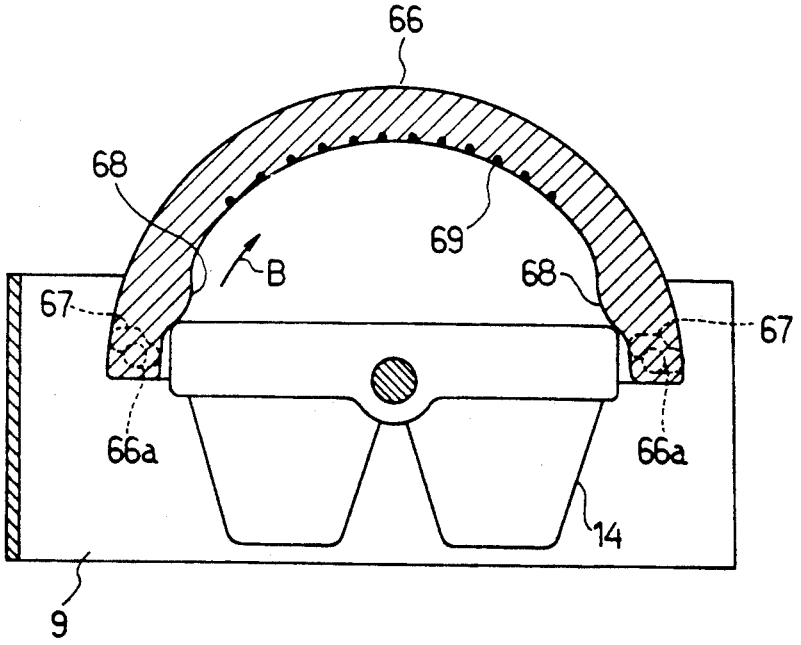
FIG. 27 is a longitudinal front view of the cover of a third modified form.
Figure 28:
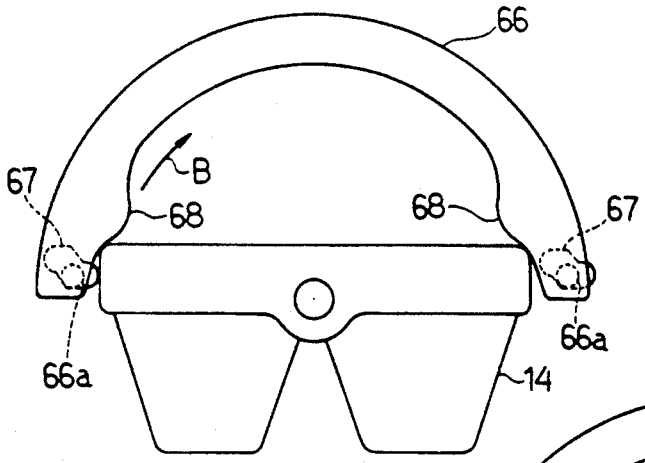
FIGS. 28(*a*) to 28(*d*) are views of the cover and the ice tray for explaining the operation of the cover.
Figure 28:
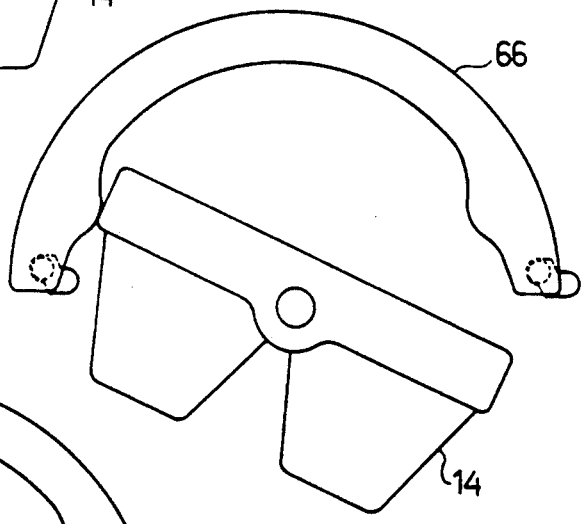
Figure 28:
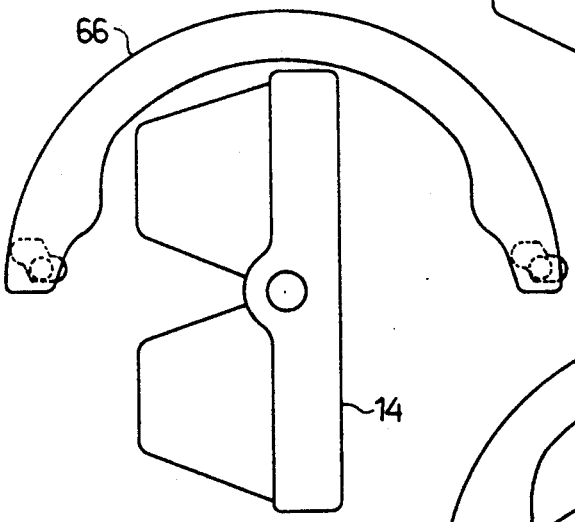
Figure 28:
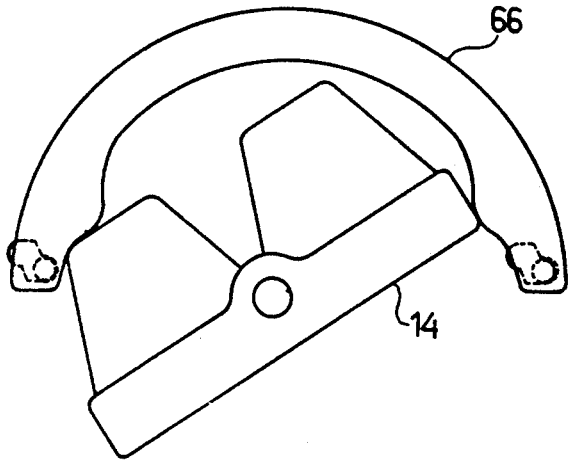
Figure 29:
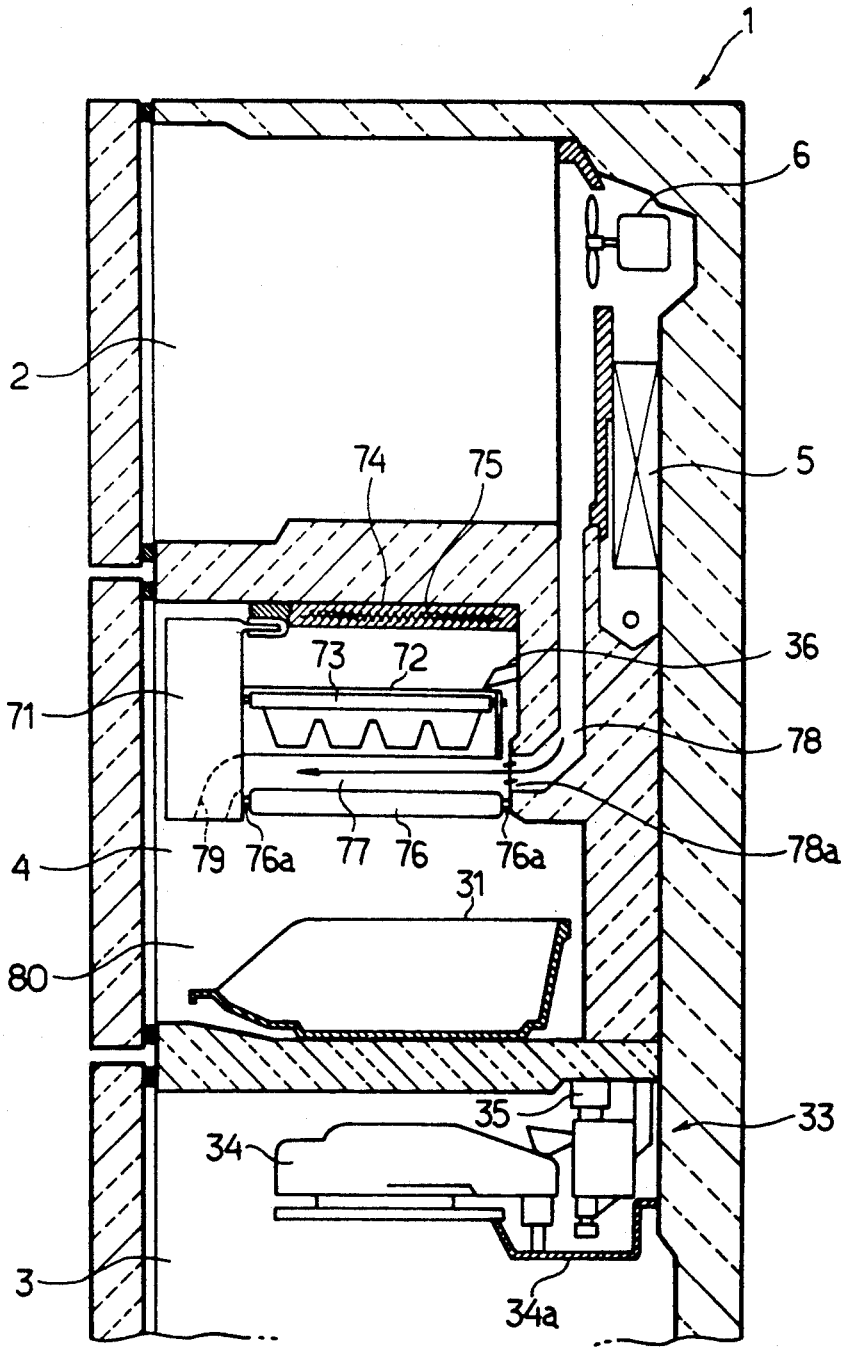
FIG. 29 is a longitudinal section of the refrigerator equipped with the ice maker of a third embodiment.
Figure 30:
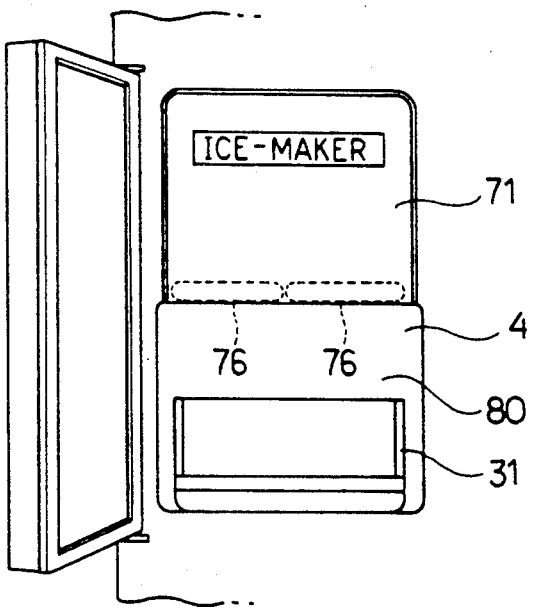
FIG. 30 is a front view of an ice making compartment of the refrigerator with a door open.
Figure 31:
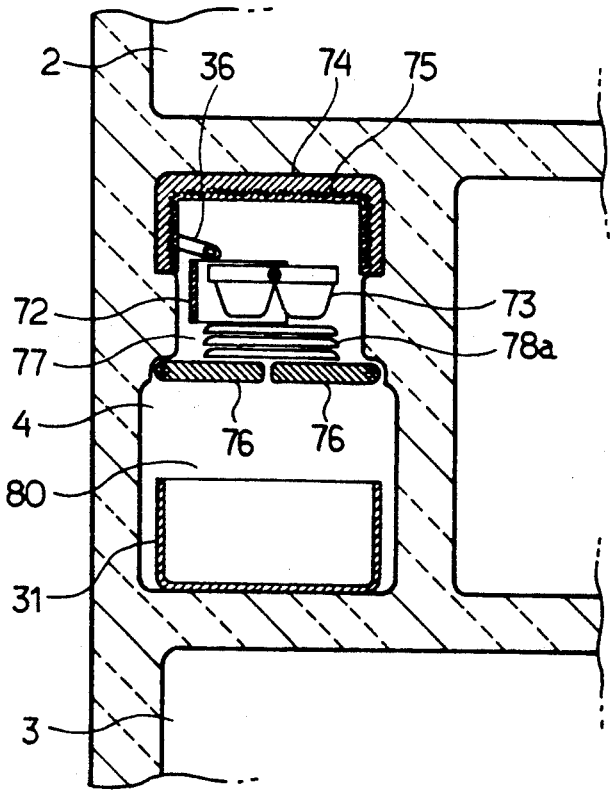
FIG. 31 is a longitudinal front view of the ice making compartment when ice is being made.

FIGS. 27 and 28 illustrate a third modified form of the cover. The cover 66 is formed into the shape of a semicircular arc. The shafts 66*a* are provided on the right-hand and left-hand ends of the front and rear sides of the cover 66, respectively. The shafts 66*a* are inserted in grooves 67 formed in the support 9 and the frame 8, respectively. The shafts 66*a* and the grooves 67 only at the support 9 side are shown in FIGS. 27 and 28. Concave portions 68 are formed on the inner right-hand and left-hand ends of the cover 66. The concave portions 68 strikes against the right-hand and left-hand ends of the ice tray from above when the ice tray occupies the ice making position. The heat 69 is provided in the inside of the cover 66.

In accordance with the above-described third modified form, the upper side of the ice tray 14 is covered by the cover 66 and is moved with the axial movement of the ice tray 14 and the heater 69 is energized to heat the water surface side during the ice making. Upon completion of the ice making, the ice tray 14 is rotatively moved in the direction of arrow B. The concave portions 68 of the cover 66 are pushed by the ice tray 14 with movement of the ice tray 14 such that the shafts 66*a* are moved in the respective grooves 67, as shown in FIGS. 28(*a*) to 28(*d*), thereby removing the ice cubes from the ice tray 14. Upon completion of the ice removal, the ice tray 14 is returned to the former horizontal position and the cover 66 is also returned to the former position with return of the ice tray 14.

FIGS. 29 to 32 illustrate a third embodiment of the invention. The frame 71 is provided at the upper front side in the ice making compartment 4 so as to close the upper half of the front side of the compartment 4. The ice tray 14 is mounted on the support 72 at the rear side of the frame 71 for the rotative movement and the forward and rearward movement. The drive mechanism for rotatively moving the ice tray 73 and the vibration applying mechanism for vibrating the ice tray 73 forward and rearward are provided in the frame 71 as in the first embodiment, neither mechanisms being shown. The cover 74 is secured to the ceiling of the ice making compartment 4 and the heater 75 is embedded in the cover 74. A pair of plate members 76 are rotatably mounted on shafts 76*a* between the rear of the frame 71 and the rear wall of the ice making compartment 4 below the ice tray 73. The plate members 76 are rotatively moved so as to be opened and closed by the drive mechanism with the rotative movement of the ice tray 73. Accordingly, when the ice tray 73 is held in the horizontal position, the plate members 76 are also held in the horizontal position so as to be closed and consequently, divide the ice making compartment interior into upper and lower compartments, defining a chilled air guide path 77 together with the ice tray 73. When the ice tray 73 is reversed in the ice removing stage, the plate members 76 are rotatively moved to a vertical position so as to be opened. A chilled air duct 78 provided on the rear wall of the ice making compartment 4 has a chilled air supply port 78*a* between the ice tray 73 and the plate members 76. Accordingly, when the plate members 76 are closed, the chilled air delivered from the chilled air supply port 78*a* is guided along the path 77, flowing along the bottom of the ice tray 73 to the front side. Thereafter, the chilled air further flows into an ice reserving section 80 through a communication path 79 formed in the lower portion of the frame 71. The ice reserving box 31 is disposed in the ice reserving section 80.

Figure 32:
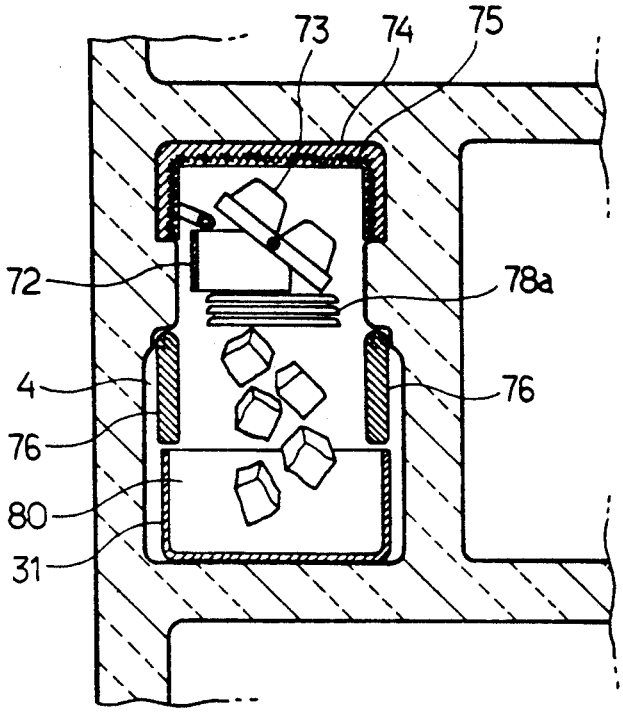
FIG. 32 is a longitudinal front view of the ice making compartment when ice cubes are being removed from the ice tray.

In accordance with the above-described construction, the bottom side of the ice tray 73 is refrigerated in the ice making stage since the chilled air is caused to flow mainly along the bottom of the ice tray 73. Furthermore, since the ice tray 73 is vibrated by the vibration applying mechanism and the upper side of the ice tray 73 is heated by the heater 75 in the ice making stage, the water in the ice tray 73 is frozen from the bottom side. Consequently, the transparent ice cubes can be made efficiently. When the ice tray 73 is reversed after completion of the ice making, the plate members 76 are rotatively moved so as to occupy the vertical position as shown in FIG. 32 with reverse of the ice tray 73 such that the ice cubes removed from the ice tray 73 fall into the ice reserving box 31 to be reserved. When the ice tray 73 is rotatively moved so as to return to the former horizontal position after completion of the ice removal, the plate members 76 are also returned to the horizontal position.

In the third embodiment, a generally U-shaped support member may be mounted on the rear of the frame 71 for mounting the cover 74 with the heater 75. A pair of plate members 76 and the ice tray 73 may be mounted between the support member and the frame 71. Thus, the ice maker may be unitized.

Figure 33:
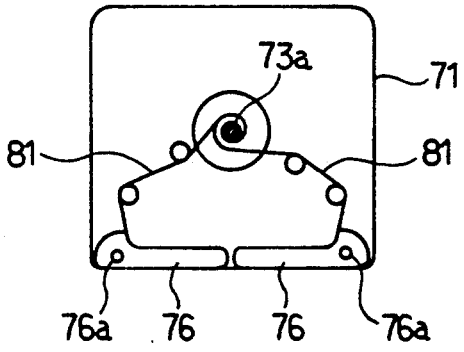
FIG. 33 is a schematic front view of a modified construction for driving a pair of opened and closed plates.

Both ends of strings 81 may be connected to the shaft 73*a* of the ice tray 73 and the shafts 76*a* of the plate members 76, respectively for the purpose of opening and closing the plate members 76, as shown in FIG. 33. When the ice tray 73 is held in the horizontal position, the strings 81 are wound up about the ice tray shaft 73*a* such that the plate members 76 is held at the horizontal position to be closed. Upon reverse of the ice tray 73, the strings 81 are loosened and then, the self-weight causes the plate members 76 to rotatively move to the vertical position.

Figure 34:
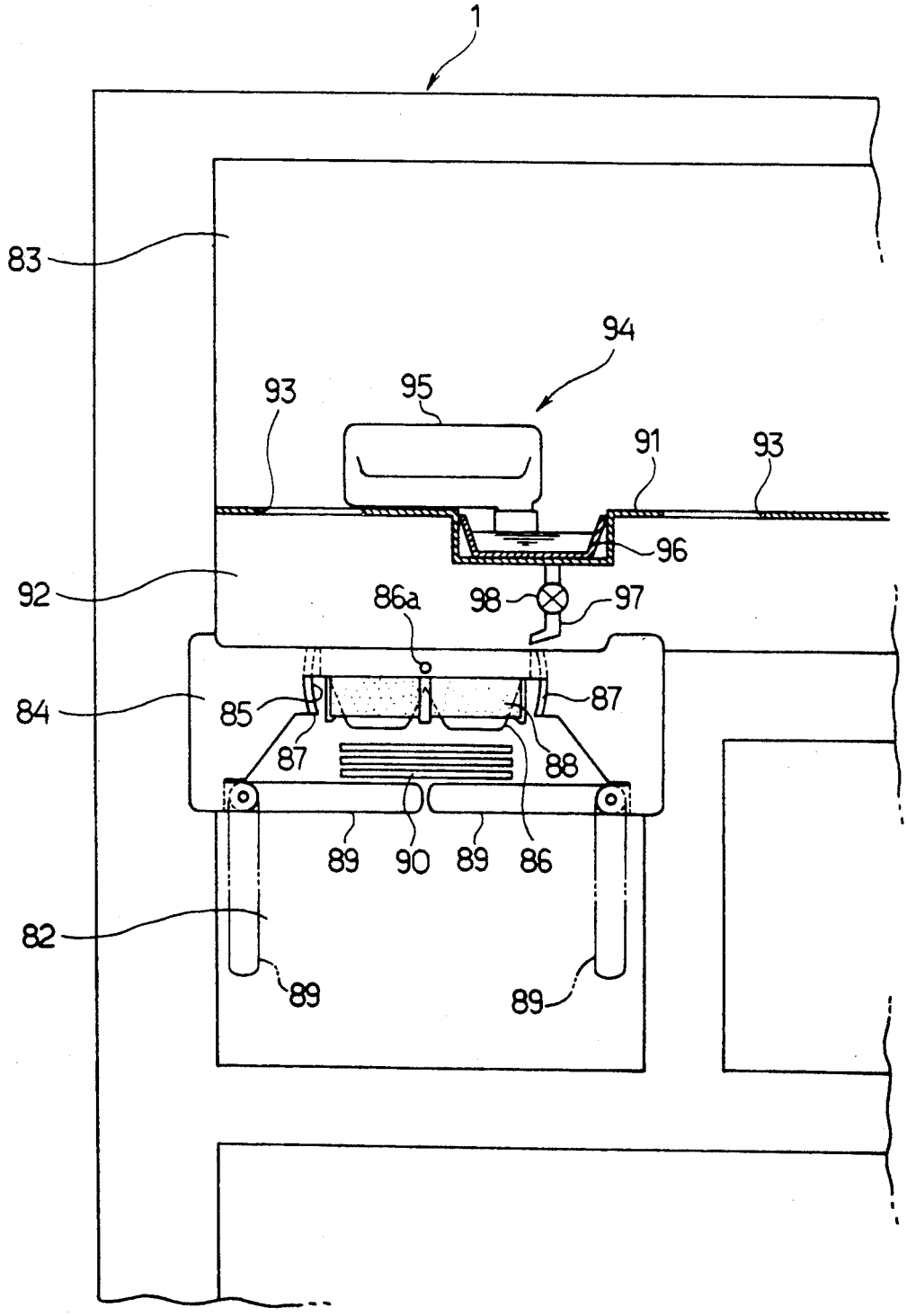
FIG. 34 is a broken front view of the freezing and ice making compartments of the refrigerator equipped with the ice maker of a fourth embodiment with doors eliminated.
Figure 35:
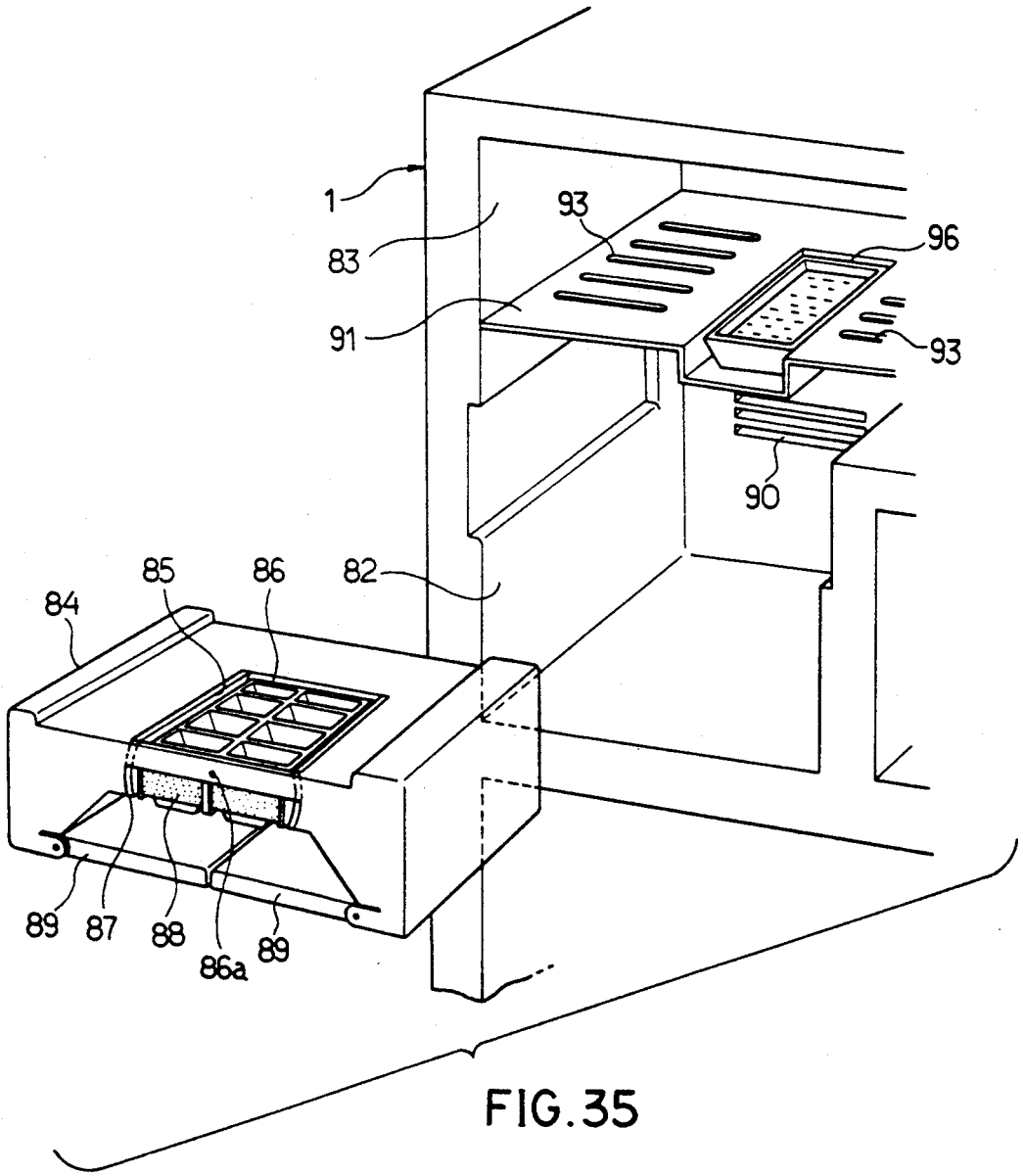
FIG. 35 is a perspective view of the freezing and ice making compartments with a partition frame removed.

FIGS. 34 and 35 illustrate a fourth embodiment of the invention. A storage compartment 83 is provided above the ice making compartment 82 so as to be communicated to the same compartment. A partition frame 84 is detachably attached on the upper interior of the ice making compartment 82. The ice making compartment 82 is partitioned by the partition frame 84 from the storage compartment 83 when the partition frame is attached. The partition frame 84 has a rectangular opening 85 and the ice tray 86 is rotatably mounted on the shafts 86*a* in the opening 85 for the rotative movement and the forward and rearward movement. The drive mechanism for rotatively moving the ice tray 86 and the vibration applying mechanism for vibrating the ice tray 86 forward and rearward are provided at the rear of the partition frame 84, neither mechanisms being shown. A rubber board 87 is attached to the inner surface of the opening 85 so as not to prevent th rotative movement of the ice tray 86. The outer periphery of the ice tray 86 is covered by the heat insulating material 88 except for the bottom thereof. A pair of plate members 89 having the same construction as in the third embodiment are provided on the lower portion of the partition frame 84. The plate members 89 are rotatively moved so as to be opened and closed with the rotative movement of the ice tray 86. The ice maker with the partition frame 84 and the ice tray 86 is unitized with the plate members 89.

The chilled air supply port 90 is formed in the rear wall of the ice making compartment 82 so as to be positioned between the ice tray 86 and the plate members 89. The chilled air from the port 90 is caused to mainly flow along the bottom of the ice tray 86.

A bottom plate 91 is disposed at the lower interior of the storage compartment 83 so as to define a predetermined space 92 with the partition frame 84. Communication holes 93 are formed in the bottom plate 91 to serve, with the bottom plate 91, as gas introducing means for introducing the gas in the storage compartment 83 into the upper side of the ice tray 86. The water-supply equipment 94 for supplying water into the ice tray 86 comprises a water-supply tank 95 disposed on the bottom plate 91, a water receiver 96 receiving water from the water-supply tank 95, a water-supply pipe 97 extended from the bottom of the water receiver 96 through the bottom plate 91 and having the distal end facing the ice tray 86 from above, and an electromagnetic valve 98 provided in the water-supply pipe 97.

In accordance with the above-described construction, the gas in the storage compartment 83 is introduced to the upper side of the ice tray 86 by the gas introducing means in the ice making stage. Since the atmospheric temperature in the storage compartment 83 is higher than that in the ice making compartment 82, the ice making at the water surface side in the ice tray 86 is retarded. Furthermore, the ice tray 86 is vibrated by the vibration applying mechanism and the chilled air supplied into the ice making compartment 82 is caused to mainly flow along the bottom of the ice tray 86. Consequently, the water in the ice tray 86 is frozen from the bottom side, which can provide the transparent ice cubes efficiently. Upon reverse of the ice tray 86 after completion of the ice making, the plate members 89 are rotatively moved to the vertical position to be opened and the ice cubes removed from the ice tray 86 falls down to be reserved. When the ice tray 86 is returned to the former horizontal position after completion of the ice removal, the plate members 89 are also returned to the former position.

In accordance with the fourth embodiment, in addition to that transparent ice cubes can be made, a water-supply pump for pumping water up is not necessitated. More specifically, since the upper interior of the ice making compartment 82 is utilized as the storage compartment 86 and the water-supply equipment 94 is provided in the storage compartment 93, the water supply from the water-supply equipment 94 to the ice tray 86 through the water-supply pipe 97 is performed by opening the electromagnetic valve 98. Thus, the water supply to the ice tray can be performed by utilizing the natural fall of water.

FIGS. 36 to 40 illustrate a fifth embodiment of the invention. The difference between the second and fifth embodiments will be described. The opened and closed cover 102 covering the upper side of the ice tray 101 comprises a container-shaped lower cover member 103 having an open upper end and an upper cover member 104 fitted in an upper opening of the lower cover member 103 so as to cover the upper end of the same. A plurality of elastically deformable claws 105 are engaged with the lower cover member 103. The cover 102 encloses a heater 107 with a heat-conduction sheet 106 and a heat insulating material 108 stacked on the heat-conduction sheet 106. Lead wires 107*a* are extended outward from the heater 107 through one side wall of the lower cover member 103. The portion of the lower cover member side wall through which the lead wires 107*a* are extended is filled in with a filler 109 for the purpose of water proof. Six mushroom-shaped projections 110 are projected from one side wall of the lower cover member 103. The distal end of each projection 110 has a larger diameter. A strip 111 is projected from the front portion of the opposite side wall of the lower cover member 103 and a socket 112 utilized for the water-supply pipe 36 end to face the ice tray 101 is formed on the rear portion of the side wall with the strip 111. The upper cover member 104 has at one side upper edge a stepped portion 113. Six projections 114 same as the projections 110 are formed on the upper portion of one side wall of the ice tray 101. A rectangular rubber sheet 115 has upper and lower rows of fitting holes 116 corresponding to the projections 110 and 114, respectively. The projections 116 of the cover 102 are fitted in the respective upper fitting holes 116 and those of the ice tray 101 are fitted in the respective lower fitting holes 116 such that the cover 102 is rotatably coupled to the ice tray 101 with the rubber sheet 115 as a hinge. A rubber fixture 117 has six grooves 118 corresponding to the projections 110 of the cover 102 and a engagement convex portion 119 formed on the upper end of the underside thereof. The fixture 117 is slid along the distal ends of the projections 110 projected from the rubber sheet 115 so that the projections 110 are fitted in the grooves 118 respectively and the convex portion 119 is engaged with the stepped portion 113 of the upper cover member 104. Thus, the fixture 117 serves to prevent separation between the upper and lower cover members 104, 103 and separation of the rubber sheet 115 from the cover 102. Another fixture 120 same as the fixture 117 is attached to the ice tray 101. The projections 114 are fitted in the respective grooves in the same manner as described above such that separation of the rubber sheet 115 from the ice tray 101 is prevented.

Figure 36:
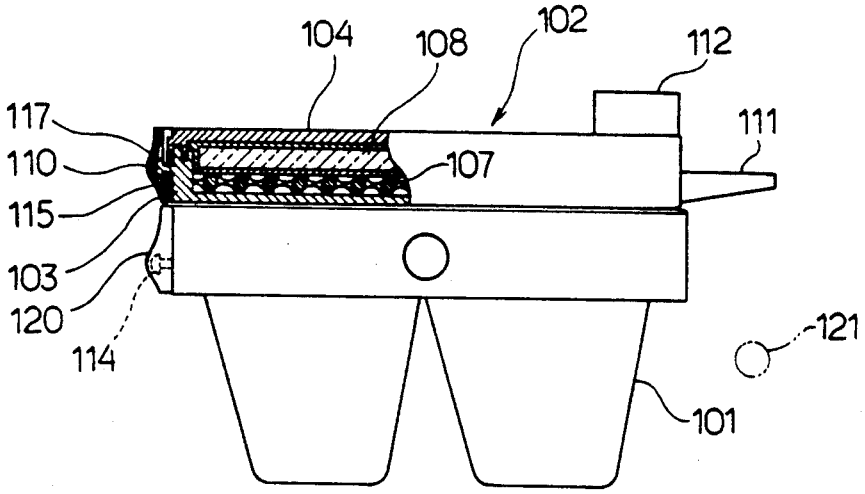
FIG. 36 is a broken front view of the ice tray and the cover of the ice maker of a fifth embodiment.
Figure 37:
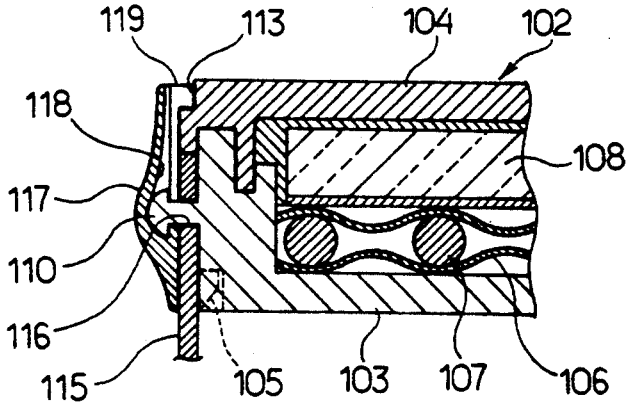
FIG. 37 is a partially enlarged longitudinal front view of the cover.
Figure 38:
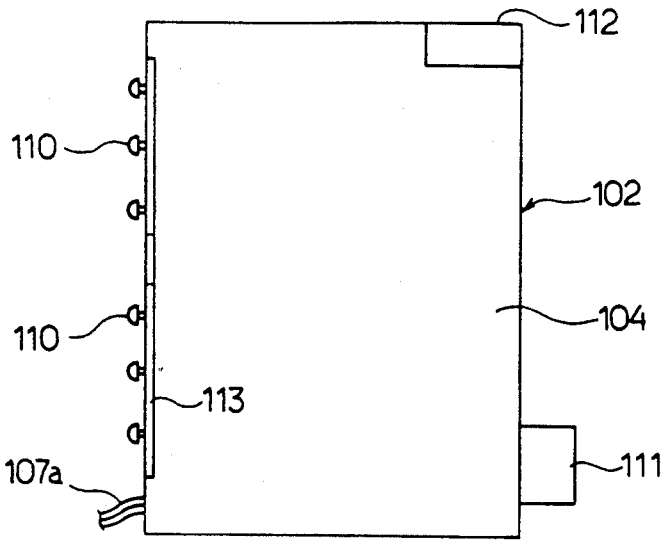
FIG. 38 is a plan view of the cover.
Figure 39:
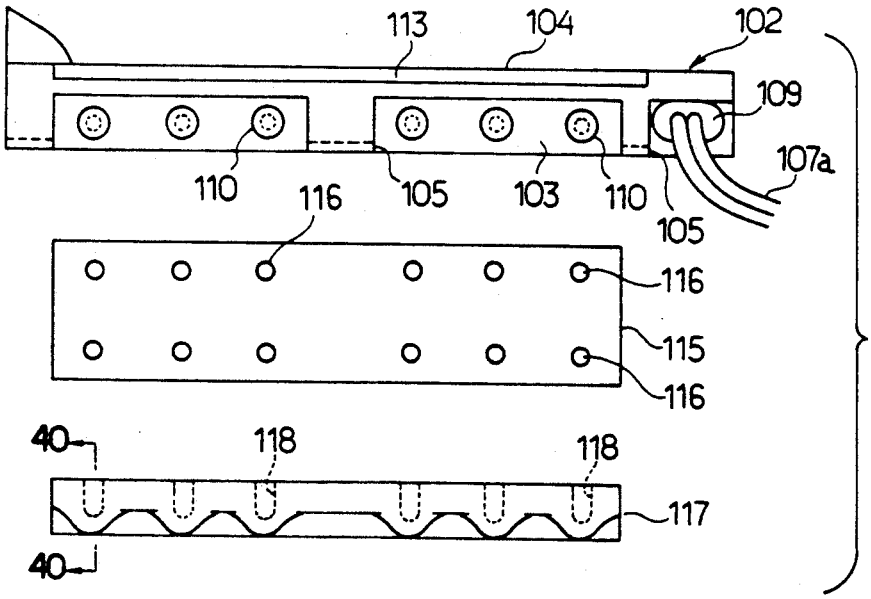
FIG. 39 is a side view of the cover, a rubber sheet and a fixture.
Figure 40:
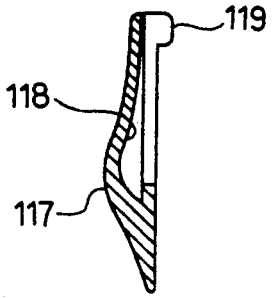
FIG. 40 is an enlarged longitudinal section of the fixture taken along line 40—40 in FIG. 39.

The strip 111 of the cover 102 is caused to strike against a convex portion 121 projected from the backside of the frame 8 (see FIG. 22) when the ice tray 101 is reversed, as shown in FIG. 36. As a result, the cover 102 is opened relative to the ice tray 101.

In accordance with the above-described construction, the cover 102 with the embedded heater 107 can be provided with a waterproof construction and accordingly, the waterproof of the cover 102 can be improved. Furthermore, since the ice tray 101 is coupled with the cover 102 via the rubber sheet 115, the twisting force of the ice tray 101 in the ice removing stage is absorbed by the rubber sheet 115. Thus, since the twisting force is not almost exerted on the cover 102, it can be prevented from being damaged. Additionally, since no screws are used in coupling the ice tray 101 to the cover 102, assembly can be simplified.

The foregoing disclosure and drawings are merely illustrative of the principles of the present invention and are not to be interpreted in a limiting sense. The only limitation is to be determined from the scope of the appended claims.

What we claim is:

1. An ice maker of a refrigerator, said ice maker having a frame member and a support member, said ice maker comprising:

an ice tray disposed between the frame member and the support member, the ice tray having opposite ends being supported by the frame member and the support member respectively, so that the ice tray is rotatively and axially movable, the ice tray having an open upper end;

spring means for axially imparting a spring force to the ice tray so that the ice tray is urged toward one of the frame member and support member;

water supply means for supplying water to the ice tray;

refrigerating means for freezing the water in the ice tray;

vibration applying means for applying motion to the ice tray in a direction against the spring force of the spring means in the water freezing stage, thereby vibrating the ice tray;

a cover member covering the open upper end of the ice tray in the water freezing stage so that the freezing of the water at a water surface side is retarded relative to the freezing of the water at a bottom side of the ice tray; and a drive mechanism for rotatively moving the ice tray after freezing of the water therein and twisting the ice tray so that ice is removed from the ice tray.

2. An ice maker according to claim 1, wherein the vibration applying means includes electromagnetic coil means reciprocally moving the ice tray axially.

3. An ice maker according to claim 1, wherein an outer periphery of a water containing concave portion of the ice tray except for a bottom face thereof is covered by a heat insulating material.

4. An ice maker according to claim 1, wherein the cover member is rotatably supported at one end by a shaft parallel to a rotational axis of the ice tray so that the cover member is rotated in contact with the ice tray with rotation of the same.

5. An ice maker according to claim 1, wherein a heater is provided in the cover member.

6. An ice maker of a refrigerator, said ice maker having a frame member and a support member, said ice maker comprising:

an ice tray disposed between the frame member and the support member, the ice tray having opposite ends being supported by the frame member and the support member respectively, so that the ice tray is rotatively and axially movable, the ice tray having an open upper end;

spring means for axially imparting a spring force to the ice tray so that the ice tray is urged toward one of the frame member and the support member;

water supply means for supplying water to the ice tray;

refrigerating means for freezing the water in the ice tray;

vibration applying means for applying motion to the ice tray in a direction against the spring force of the spring means in the water freezing stage, thereby vibrating the ice tray;

heating means provided for heating a surface of the water in the ice tray in the water freezing stage so that the freezing of the water at a water surface side is retarded relative to the freezing of the water at a bottom side of the ice tray; and a drive mechanism for rotatively moving the ice tray after freezing of the water therein and twisting the ice tray so that ice is removed from the ice tray.

7. An ice maker according to claim 6, wherein the vibration applying means includes electromagnetic coil means reciprocally moving the ice tray axially.

8. An ice maker according to claim 6, wherein an outer periphery of a water containing concave portion of the ice tray except for a bottom face thereof is covered by a heat insulating material.

9. An ice maker according to claim 6, wherein the cover member is rotatably supported at one end by a shaft parallel to a rotational axis of the ice tray so that the cover member is rotated in contact with the ice tray with rotation of the same.

* * * * *